US009591926B2

(12) United States Patent
Harte

(10) Patent No.: US 9,591,926 B2
(45) Date of Patent: Mar. 14, 2017

(54) PROSTATIC RELIEF CUSHION AND METHOD

(71) Applicant: Glenn W. Harte, Mesquite, NV (US)

(72) Inventor: Glenn W. Harte, Mesquite, NV (US)

( * ) Notice: Subject to any disclaimer, the term of this patent is extended or adjusted under 35 U.S.C. 154(b) by 0 days.

(21) Appl. No.: 15/055,765

(22) Filed: Feb. 29, 2016

(65) Prior Publication Data

US 2016/0255961 A1 Sep. 8, 2016

Related U.S. Application Data

(60) Provisional application No. 62/127,548, filed on Mar. 3, 2015.

(51) Int. Cl.
*A47C 7/02* (2006.01)
*A47C 7/74* (2006.01)

(52) U.S. Cl.
CPC ..... *A47C 7/744* (2013.01); *A47C 7/021* (2013.01); *A47C 7/022* (2013.01)

(58) Field of Classification Search
CPC ..... A47C 7/744; A47C 7/021
USPC ..... 297/452.22, 452.44, 452.45, 452.46, 297/452.47, 180.11, 180.13, 180.14, 297/180.1; 5/652, 653, 630, 901
See application file for complete search history.

(56) References Cited

U.S. PATENT DOCUMENTS 654,720 A * 7/1900 Englebert ..... B62J 1/002 297/202
859,828 A * 7/1907 McCloud ..... A47C 7/022 297/452.22
1,568,471 A * 1/1926 Roemer ..... B60N 2/5635 297/452.47
2,260,437 A * 10/1941 Chambers ..... A47C 7/021 4/456
2,853,124 A * 9/1958 Shapiro ..... A47C 7/46 297/452.44
3,514,793 A * 6/1970 West ..... A47C 7/021 4/239
4,212,692 A 7/1980 Rasen et al.
4,779,297 A * 10/1988 Sturges ..... A47C 20/026 5/630
4,923,248 A * 5/1990 Feher ..... A47C 7/74 297/180.11

(Continued)

FOREIGN PATENT DOCUMENTS

CN 101537809 A 9/2009

OTHER PUBLICATIONS

Back Be Nimble,Your One Stop Back Shop, catalog, www.backbenimble.com/prostatitis-prostate-cushion.htm.

(Continued)

*Primary Examiner* — Laurie K Cranmer
(74) *Attorney, Agent, or Firm* — Arthur Jacob

(57) ABSTRACT

A cushion and method provide relief of pain or discomfort in the pelvic/genital/rectal region of a person. The person is supported on a resilient cushion construct which conforms to the person's posterior profile contour configuration, while locating a gap beneath the pelvic/genital/rectal region of the person. An airway is extended to the gap, through a basal construct located beneath the cushion construct and an air mover moves ambient air through the airway and into the gap to provide cooling to the pelvic/genital/rectal region of the person supported on the cushion construct.

20 Claims, 2 Drawing Sheets

(56) References Cited

U.S. PATENT DOCUMENTS 5,702,153 A * 12/1997 Pliska ..... A47C 7/022 297/230.1
5,788,332 A * 8/1998 Hettinga ..... B60N 2/7017 297/452.55
6,068,332 A * 5/2000 Faust ..... A47C 7/74 297/180.11
6,523,202 B2 * 2/2003 Loomos ..... A47C 7/022 5/653
7,070,231 B1 * 7/2006 Wong ..... A47C 7/74 297/180.1
7,083,236 B1 * 8/2006 Smith ..... A47C 7/742 297/229
7,117,611 B2 * 10/2006 Park ..... A47K 10/48 297/180.14
7,344,196 B2 * 3/2008 Rodriquez ..... A47C 7/021 297/180.11
8,127,383 B2 * 3/2012 Gladney ..... A47C 27/002 5/652
8,468,628 B1 * 6/2013 Cheng ..... A47G 9/007 5/632
8,696,059 B2 * 4/2014 Carmichael, IV ..... A47C 7/02 297/195.11
2003/0204913 A1 * 11/2003 McKinney ..... A47C 7/021 5/655.3
2005/0066505 A1 * 3/2005 Iqbal ..... A47C 7/72 29/428
2008/0084095 A1 * 4/2008 Wolas ..... A47C 7/72 297/180.11
2008/0290702 A1 * 11/2008 Shin ..... B60N 2/5628 297/180.13
2012/0079661 A1 * 4/2012 Chen ..... A63B 21/4037 5/655.5
2015/0061331 A1 * 3/2015 Yang ..... A47C 7/744 297/180.14
2015/0224006 A1 * 8/2015 Primo ..... A47C 7/744 297/180.14
2015/0239321 A1 * 8/2015 Muller ..... B60H 1/00792 297/180.1
2016/0152167 A1 * 6/2016 Kozlowski ..... B60N 2/5692 297/180.12

OTHER PUBLICATIONS

Support Plus, http://www.supportplus.com/cgi-bin/hazel.cgi?action=DETAIL&ITEM=FE1852.
http://www.amazon.com/ERGO-Pedic-Coccyx-Cushion-Memory-Airplane/dp/B00MP38M64/ref=sr_1_1?ie=UTF8&qid=1456756570&sr=8-1&keywords=ergo-pedic+comfort+cushion/.
http://prostate-cushion.com.

* cited by examiner

PROSTATIC RELIEF CUSHION AND METHOD

This application claims the benefit of U.S. Provisional Patent Application Ser. No. 62/127,548, filed Mar. 3, 2015, the subject matter of which is incorporated herein by reference thereto.

The present invention relates generally to the relief of pain or discomfort in the pelvic/genital/rectal regions of the human body and pertains, more specifically, to the relief of the effects of prostatism.

A wide variety of devices, usually in the form of seat cushions, have been made available for the relief of pain or discomfort arising out of disorders occurring in the pelvic area of the human body. In particular, a number of cushions currently are available which purport to relieve pain and discomfort related to prostatic disorders, while a person is seated, usually for extended periods. The present invention provides a cushion construction created to relieve pain and discomfort associated with such conditions and, in particular, symptoms connected with prostatitis. As such, the present invention attains several objects and advantages, some of which are summarized as follows: Alleviates pain and discomfort while a person is seated, arising out of disorders in the pelvic/genital/rectal regions and, in particular, in connection with the presence of prostatitis; provides a cushion construction readily employed in connection with conventional seating for the relief of prostatic pain and discomfort which otherwise might be experienced under ordinary seating arrangements; exhibits a high degree of comfort and convenience when employed in a wide variety of seating venues, including home, workplace and vehicular seating; provides a relatively simple cushion construction, economically manufactured and easily put into place for exemplary performance; offers a unique combination of structural integrity and effective performance in alleviating symptoms connected with prostatitis in a relatively simple and compact cushion construction; provides a rugged construction for reliable performance over long-term service.

The above objects and advantages, as well as further objects and advantages, are attained by the present invention, which may be described briefly as a cushion for providing the relief of pain or discomfort in the pelvic/genital/rectal region of a person, the cushion comprising: a cushion construct having a resilient core for supporting the person while conforming to the person's posterior profile contour configuration, the cushion construct including laterally spaced apart, longitudinally extending members establishing a gap between the members; and a basal construct beneath the cushion construct, the basal construct including an airway between an air inlet and at least one air outlet, the one air outlet being located at the gap, the airway being arranged for conducting ambient air from the air inlet to the one air outlet, and an air mover arrangement for moving ambient air from the air inlet, through the airway, and out the one air outlet into the gap to provide cooling to the pelvic/genital/rectal region of the person supported on the cushion construct.

In addition, the present invention includes a method for providing the relief of pain or discomfort in the pelvic/genital/rectal region of a person, the method comprising: supporting the person on a cushion construct having a resilient core capable of conforming to the person's posterior profile contour configuration, the cushion construct including laterally spaced apart, longitudinally extending members establishing a gap between the members; and providing a basal construct beneath the cushion construct, the basal construct including arranging an airway between an air inlet and at least one air outlet, and locating the one air outlet at the gap for conducting ambient air from the air inlet to the one air outlet, and moving ambient air from the air inlet, through the airway, and out the one air outlet into the gap to provide cooling to the pelvic/genital/rectal region of the person supported on the cushion construct.

The invention will be understood more fully, while still further objects and advantages will become apparent, in the following detailed description of preferred embodiments of the invention illustrated in the accompanying drawing, in which.

Figure 1:
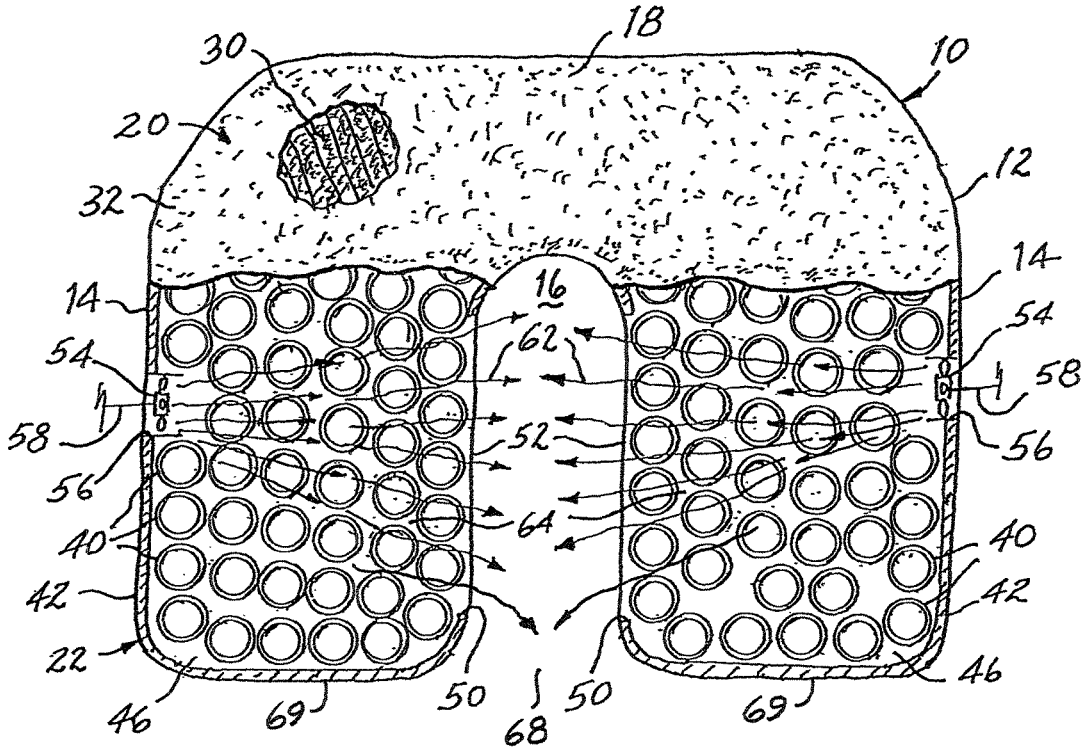
FIG. 1 is a somewhat diagrammatic, top plan view of a prostatic relief cushion constructed in accordance with the present invention, with portions broken away to reveal internal structural details.
Figure 2:
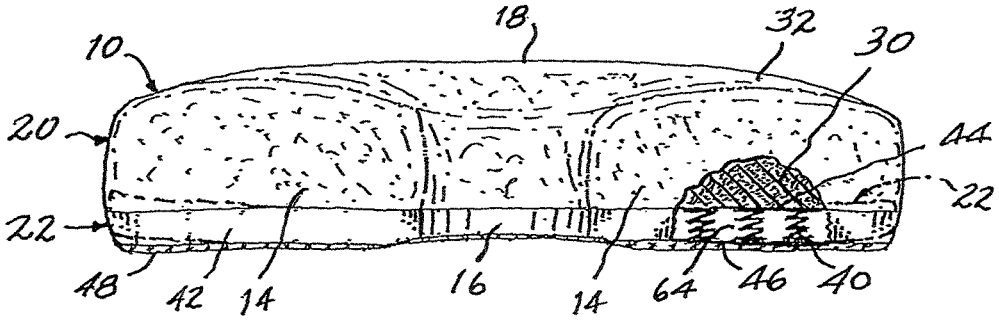
FIG. 2 is a front elevational view of the prostatic relief cushion, with portions broken away to reveal internal structural details.
Figure 3:
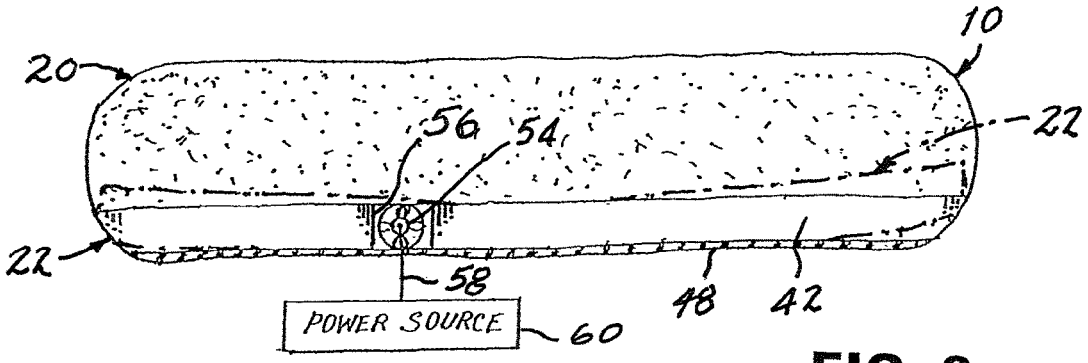
FIG. 3 is a partially diagrammatic side elevational view of the prosthetic relief cushion.

Referring now to the drawing, and especially to FIGS. 1 through 3 thereof, a prostatic relief cushion constructed in accordance with the present invention is shown at 10 and is seen to have an overall U-shaped plan configuration 12 including a pair of laterally spaced apart, longitudinally extending members, shown in the form of legs 14 establishing a laterally central gap 16 located between the legs 14, and an integrated, laterally extending connecting spine 18. Cushion construction 10 includes a resilient cushion construct 20 affixed to a resiliently flexible basal construct 22.

Cushion construct 20 is comprised of a core 30, preferably made up of a synthetic polymeric foam material, commonly known as a "memory foam", and a fabric cover 32 encasing the core 30. Basal construct 22 includes substrate comprised of a multiplicity of resiliently flexible elements, shown in the form of independent coil springs 40, encased within a peripheral wall 42, and extending altitudinally between upper and lower partitions 44 and 46, respectively, in a manner similar to the construction of a coil spring mattress. Cushion 10 is dimensioned for placement upon a seat (not shown) to receive a seated person (not shown), and a bottom layer 48 of a soft, conformable material, such as felt or a foamed synthetic polymeric material, is affixed to lower partition 46 to protect the seat against marring, scratching or other damage, while assisting in maintaining cushion 10 in place upon the seat.

As best seen in FIG. 1, peripheral wall 42 includes openings 50 confronting one another in juxtaposition with gap 16, at laterally opposite sides 52 of gap 16, and an air mover in the form of a small electrically-operated fan 54 is placed within an air inlet 56 in peripheral wall 42, with each fan 54 located laterally opposite a corresponding opening 50. Each fan 54 is connected, via a line 58, to a power source 60 which, in domestic and commercial venues, may be in the form of conventional AC power, or in a vehicle, may be in the form of a conventional vehicle power supply.

In use, with cushion 10 in place upon a seat, a person is seated upon cushion construct 20, with the person's prostate area juxtaposed with gap 16. Comfort is provided by the combination of resilient core 30, which conforms to the person's posterior profile contour configuration, and the multiplicity of coil springs 40, which allow some flexing of basal construct 22, as illustrated in phantom in FIGS. 2 and 3. Once the person is appropriately situated on cushion 10, with the person's posterior positioned upon legs 14 of cushion 10, fans 54 are activated to draw ambient air through air inlets 56 and direct a flow 62 of cooling air through openings 50, into gap 16 and to the person's prostate area, thus soothing and relieving any pain or discomfort being experienced by the seated person as a result of inflammation caused by prostatitis. By virtue of the open construction of coil springs 40, and the concomitant air flow permeability provided by the clear airways established by the open structure across basal construct 22, as illustrated at 64 in FIGS. 2 and 3, the flow 62 of cooling air from each air inlet 56 to a corresponding opening 50, and into gap 16, is facilitated, while the integrity and flexibility of basal construct 22, as well as of cushion construct 20, is maintained. The overall U-shaped plan configuration 12 of cushion 10 enables the flow 62 of air to be exhausted from gap 16 at exhaust outlet 68 located between the remote terminal ends 69 of the legs 14 to establish an exit from the cushion so as to facilitate a continuous exchange of air within gap 16 and the concomitant continued soothing and relief provided by a fresh supply of cool air adjacent the person's pelvic/genital/rectal regions. It will be apparent that the same soothing and relief is made available by cushion 10 to persons suffering from symptoms caused by inflammation resulting from rectal maladies such as hemorrhoids, by certain genital maladies or by maladies resulting in inflammation in the pelvic area.

Figure 4:
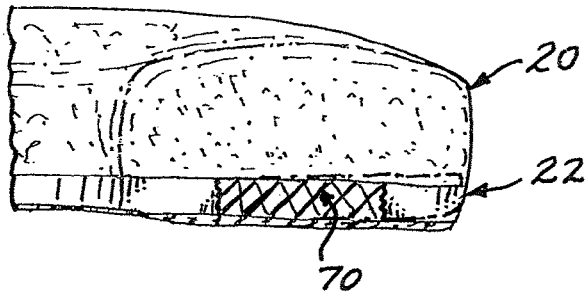
FIG. 4 is a fragmentary front elevational view similar to a portion of FIG. 2, showing an alternate construction.

Turning now to the embodiment illustrated in FIG. 4, in an alternate construction, the multiplicity of coil springs 40 illustrated in the embodiment of FIGS. 1 through 3 have been replaced by a substrate comprised of a metallic mesh 70 constructed in the manner disclosed in U.S. Pat. No. 8,127,383, the disclosure of which is incorporated herein by reference thereto. Metallic mesh 70 is provided with sufficient structural strength to withstand the weight-bearing and contour-conforming demands of a cushion, while facilitating the resilient flexibility and the air flow permeability desired in a prostatic relief cushion, as described above.

Figure 5:
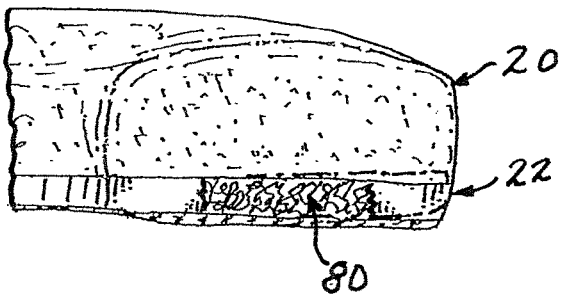
FIG. 5 is a fragmentary front elevational view similar to a portion of FIG. 2, showing another alternate construction.

With reference to the embodiment illustrated in FIG. 5, in another alternate construction, the multiplicity of coil springs 40 illustrated in the embodiment of FIGS. 1 through 3 have been replaced by a substrate comprised of a random mesh 80 of plastic filaments, constructed in the manner disclosed in U.S. Pat. No. 5,788,332, the disclosure of which is incorporated herein by reference thereto. Mesh 80 is provided with sufficient structural strength to withstand the weight-bearing and contour-conforming demands of a cushion, while facilitating the resilient flexibility and the air flow permeability desired in a prostatic relief cushion, as described above. Random mesh 80 may be produced economically in the form of intermingled or tangled synthetic polymeric fibers, in a manner similar to that disclosed in U.S. Pat. No. 4,212,692, the disclosure of which is incorporated herein by reference thereto.

It will be seen that the present invention attains all of the objects and advantages summarized above, namely: Alleviates pain and discomfort while a person is seated, arising out of disorders in the pelvic/genital/rectal regions and, in particular, in connection with the presence of prostatitis; provides a cushion construction readily employed in connection with conventional seating for the relief of prostatic pain and discomfort which otherwise might be experienced under ordinary seating arrangements; exhibits a high degree of comfort and convenience when employed in a wide variety of seating venues, including home, workplace and vehicular seating; provides a relatively simple cushion construction, economically manufactured and easily put into place for exemplary performance; offers a unique combination of structural integrity and effective performance in alleviating symptoms connected with prostatitis in a relatively simple and compact cushion construction; provides a rugged construction for reliable performance over long-term service.

It is to be understood that the above detailed description of preferred embodiments of the invention are provided by way of example only. Various details of design, construction and procedure may be modified without departing from the true spirit and scope of the invention, as set forth in the appended claims.

The embodiments of the invention in which an exclusive right or privilege is claimed are defined as follows:

1. A cushion for accommodating a posterior profile contour configuration present at the pelvic/genital/rectal region of a person to provide the person with relief of pain or discomfort, the cushion comprising:

a cushion construct having a resilient core for supporting the person while conforming to the posterior profile contour configuration, the cushion construct having a U-shaped plan configuration including a laterally extending spine and laterally spaced apart, longitudinally extending legs projecting from the laterally extending spine to corresponding remote terminal ends and establishing a gap between the legs, the gap extending longitudinally along the legs from the laterally extending spine to the corresponding remote terminal ends of the legs; and a basal construct affixed to the cushion construct beneath the cushion construct, the basal construct including a substrate having a U-shaped plan configuration corresponding to the U-shaped plan configuration of the cushion construct, the basal construct including a peripheral wall extending around the substrate;

an airway within the substrate, the airway extending between an air inlet in the peripheral wall and a corresponding air outlet, the corresponding air outlet being located in juxtaposition with the gap, the airway being arranged for conducting ambient air from the air inlet to the corresponding air outlet, and an air mover arrangement for moving ambient air from the air inlet, through the airway, and out the corresponding air outlet into the gap, then through the gap and out of the cushion at an exhaust outlet located between the corresponding remote terminal ends of the legs to provide an exit from the cushion for enabling a flow of continuously exchanged cooling ambient air through the gap and out of the cushion at the exhaust outlet and directing the flow of continuously exchanged cooling ambient air to the pelvic/genital/rectal region of the person supported on the cushion construct, thereby providing the person with relief of pain or discomfort.

2. The cushion of claim 1 wherein a corresponding air outlet is located in each leg, in juxtaposition with the gap, and a corresponding airway is arranged for conducting ambient air to each corresponding air outlet.

3. The cushion of claim 2 wherein the air mover arrangement includes an air mover associated with each corresponding air outlet.

4. The cushion of claim 2 wherein the substrate is comprised of resiliently flexible elements.

5. The cushion of claim 4 wherein the resiliently flexible elements comprise independent coil springs.

6. The cushion of claim 5 wherein the air mover arrangement includes an air mover associated with each corresponding air outlet.

7. The cushion of claim 2 wherein the substrate is comprised of a metallic mesh.

8. The cushion of claim 7 wherein the air mover arrangement includes an air mover associated with each corresponding air outlet.

9. The cushion of claim 2 wherein the substrate is comprised of a random mesh of intermingled synthetic polymeric fibers.

10. The cushion of claim 9 wherein the air mover arrangement includes an air mover associated with each corresponding air outlet.

11. A method for accommodating a posterior profile contour configuration present at the pelvic/genital/rectal region of a person to provide the person with relief of pain or discomfort, the method comprising:

providing a cushion construct having a resilient core capable of conforming to the posterior profile contour configuration, the cushion construct having a U-shaped plan configuration including a laterally extending spine and laterally spaced apart, longitudinally extending legs projecting from a lateral extending spine to corresponding remote terminal ends of the legs and establishing a gap between the legs, the gap extending longitudinally along the legs from the laterally extending spine to the corresponding remote terminal ends of the legs;

affixing a basal construct to the cushion construct, beneath the cushion construct, the basal construct including a substrate having a U-shaped plan configuration corresponding to the U-shaped plan configuration of the cushion construct and a peripheral wall extending around the substrate;

arranging an airway within the substrate, with the airway extending between an air inlet in the peripheral wall and a corresponding air outlet, and locating the corresponding air outlet at the gap for conducting ambient air from the air inlet to the corresponding air outlet; and moving ambient air from the air inlet, through the airway, and out the corresponding air outlet into the gap, then through the gap and out of the cushion at an exhaust outlet located between the corresponding remote terminal ends of the legs to provide an exit from the cushion enabling a flow of continuously exchanged cooling ambient air through the gap and out of the cushion at the exhaust outlet, with the flow of continuously exchanged cooling ambient air directed to the pelvic/genital/rectal region of the person supported on the cushion construct, thereby providing the person with relief of pain or discomfort.

12. The method of claim 11 including locating a corresponding air outlet in each leg, in juxtaposition with the gap, and arranging a corresponding airway for conducting ambient air to each corresponding air outlet.

13. The method of claim 12 including associating an air mover with each corresponding air outlet.

14. The method of claim 12 including constructing the substrate of resiliently flexible elements.

15. The method of claim 14 including constructing the resiliently flexible elements in the form of independent coil springs.

16. The method of claim 15 including associating an air mover with each corresponding air outlet.

17. The method of claim 12 including constructing the substrate comprised of a metallic mesh.

18. The method of claim 17 including associating an air mover with each corresponding air outlet.

19. The method of claim 12 including constructing the substrate comprised of a random mesh of intermingled synthetic polymeric fibers.

20. The method of claim 19 including associating an air mover with each corresponding air outlet.

* * * * *